United States Patent [19]

Aggen et al.

[11] 4,414,023

[45] Nov. 8, 1983

[54] IRON-CHROMIUM-ALUMINUM ALLOY AND ARTICLE AND METHOD THEREFOR

[75] Inventors: George Aggen; Paul R. Borneman, both of Sarver, Pa.

[73] Assignee: Allegheny Ludlum Steel Corporation, Pittsburgh, Pa.

[21] Appl. No.: 367,710

[22] Filed: Apr. 12, 1982

[51] Int. Cl.[3] ..... C22C 38/06

[52] U.S. Cl. ..... 75/124; 75/124; 75/126 G; 148/37

[58] Field of Search ..... 75/124 C, 124 F, 126 G; 148/31.5, 37

[56] References Cited

U.S. PATENT DOCUMENTS

| | | | |
|---|---|---|---|
| 2,191,790 | 2/1940 | Franks | 75/126 |
| 2,580,171 | 12/1951 | Hägglund et al. | 75/124 FA |
| 2,635,164 | 4/1953 | Rehnqvist et al. | 201/67 |
| 2,703,355 | 3/1955 | Hägglund | 201/67 |
| 3,027,252 | 3/1962 | McGurty et al. | 75/126 |
| 3,171,737 | 3/1965 | Spooner et al. | 75/124 F |
| 3,298,826 | 1/1967 | Wukusick | 75/124 |
| 3,746,536 | 7/1973 | Kuse | 75/124 |
| 3,782,925 | 1/1974 | Brandis et al. | 75/124 |
| 3,920,583 | 11/1975 | Pugh | 252/465 |
| 4,141,762 | 2/1979 | Yamaguchi et al. | 75/124 C |
| 4,219,592 | 8/1980 | Anderson et al. | 428/679 |
| 4,230,489 | 10/1980 | Antill | 75/124 |
| 4,286,986 | 9/1981 | Borneman | 75/124 F |
| 4,299,621 | 11/1981 | Giflo | 75/124 C |

FOREIGN PATENT DOCUMENTS

| | | |
|---|---|---|
| 56-65966 | 6/1981 | Japan . |
| 63723 | 6/1981 | United Kingdom . |

*Primary Examiner*—Veronica O'Keefe

*Attorney, Agent, or Firm*—Patrick J. Viccaro

[57] ABSTRACT

A ferritic stainless steel alloy is provided which is hot workable and is resistant to thermal cyclic oxidation and scaling at elevated temperatures. The iron-chromium-aluminum alloy contains cerium, lanthanum and other rare earths and is suitable for forming thereon an adherent textured aluminum oxide surface. An oxidation resistant catalytic substrate made from the alloy and a method of making the alloy are also provided.

23 Claims, 5 Drawing Figures

IRON-CHROMIUM-ALUMINUM ALLOY AND ARTICLE AND METHOD THEREFOR

BACKGROUND OF THE INVENTION

This invention relates to thermal cyclic oxidation resistant and hot workable alloys. More particularly, the invention relates to iron-chromium-aluminum alloys with rare earth additions, particularly cerium and lanthanum.

It is known to provide iron-chromium-aluminum alloys having additions of yttrium for the purpose of high temperature oxidation resistance and improved oxide surfaces. U.S. Pat. No. 3,027,252, issued May 27, 1962, disclosed at 25–95% chromium, 0.5–4% aluminum and 0.5–3% yttrium alloy for high temperature oxidation resistance at greater than 2000° F. (1094° C.). An objective of the alloy was to provide improved workability and a thermal shock resistant and non-spalling oxide film. Another patent No. 3,298,826, issued Jan. 17, 1967, has as its objective to improve the resistance to embrittlement and hardening of the alloys between 650–1300° F. (343–704° C.) while retaining the oxidation and corrosion resistance. The patent discloses that embrittlement is avoided by lowering the chromium content below 15%. U.S. Pat. No. 4,230,489, issued Oct. 28, 1980, relates to the addition of 1 to 2% silicon to such alloys for increasing the corrosion resistance.

Generally, such alloys have properties which are useful in high temperature environments which require oxidation resistance and it has been proposed that they may be useful as a substrate material such as for catalytic converters, as well as for resistance heating elements and radiant heating elements in gas or oil stoves. As a catalytic substrate, a metallic substrate offers many advantages over present ceramic substrates. For example, a metal substrate is substantially more shock resistant and vibration resistant, as well as having a greater thermal conductivity, than ceramic. Furthermore, a metallic substrate can be more easily fabricated into thin foil and fine honeycomb configurations to provide greater surface area and lighter weight.

Present iron-chromium-aluminum alloys containing yttrium may provide some satisfactory properties of oxidation resistance and adherence of oxide films, however, the use of yttrium has its disadvantages. Yttrium is expensive and is subject to "fade" during melting and pouring of ferrous alloys. Yttrium, because of its highly reactive nature, combines with other elements such as oxygen and is lost to the slag and furnace refractories. Generally, because of the highly reactive nature of yttrium, a more costly process of vacuum induction melting is used for producing iron-chromium-aluminum alloys containing yttrium. Furthermore, during vacuum melting and casting, recovery of yttrium in the metal may typically be less than 50% of that added to the melt composition. If there are any delays or problems which would prevent immediate pouring of the melt, recovery may be substantially lower. Moreover, even vacuum induction melting is inadequate for substantial recovery of yttrium through the remelting of the scrap of yttrium-containing alloys.

U.S. Pat. No. 3,920,583, issued Nov. 18, 1975, relates to a catalytic system including an aluminum-bearing ferritic steel substrate and, particularly, an iron-chromium-aluminum-yttrium alloy. The alloy is disclosed to have the property of forming an adherent stable alumina layer upon the substrate surface upon heating such that the layer protects the steel and makes it oxidation resistant.

To overcome some of the disadvantages of yttrium-containing iron-chromium-aluminum alloys, it has been proposed that other lower cost alloying metals be substituted for yttrium. U.S. Pat. No. 3,782,925, issued Jan. 1, 1974, discloses a ferritic heat resistant iron-chromium-aluminum steel having silicon, titanium and rare earth additions. The alloy contains 10–15% chromium, 1–3.5% aluminum, 0.8–3% silicon and 0.01–0.5% calcium, cerium and/or other rare earths for scale adherence. The patent also requires a total of aluminum and silicon ranging from 2–5%, free titanium of at least 0.2% and a sum of oxygen and nitrogen of at least 0.05%.

An article entitled "High Temperature Oxidation Behavior of Fe-20 Cr-4 Al Alloys With Small Additions of Cerium" by Amano et al, Trans. JIM 1979, Vol. 20, discloses an iron-chromium-aluminum alloy with increasing cerium additions for good adherence of the oxide surface. The article discloses static oxidation tests at cerium amounts of 0.01%, 0.04% and 0.37%. While there was spalling of the oxide coating at the lowest cerium level of 0.01%, no spalling was reported at the higher levels of 0.04% and 0.37% cerium. The cerium existed in the latter two alloys as a Ce-Fe intermetallic compound which precipitated at the grain boundaries. The article does not address thermal cyclic oxidation resistance and hot workability of the alloys.

Other iron-chromium-aluminum alloys containing cerium are known for electrical resistance heating elements. U.S. Pat. No. 2,191,790 discloses up to 5% of an addition chosen from a group of cerium and other elements and further includes up to 0.5% carbon and 0.05–0.5% nitrogen. The objective of the alloy was to improve oxidation resistance, scale adherence and toughness at elevated temperatures greater than 2102° F. (1150° C.). Improvements over the alloy of that patent are shown in U.S. Pat. No. 2,635,164, issued Apr. 14, 1953, and U.S. Pat. No. 2,703,355, issued Mar. 1, 1955.

Japanese Patent Application No. 56-65966, published on June 4, 1981, also discloses an iron-chromium-aluminum alloy having heat absorbing and radiating properties for combustion devices.

It is also known to provide a glass sealing alloy of iron, chromium and aluminum with additions of rare earths up to 2%, disclosed in U.S. Pat. No. 3,746,536, issued July 17, 1973.

There still exists a need, however, for an alloy which is less expensive to produce because of lower cost alloying elements, which can be produced through lower cost melting processes and which is resistant to thermal cyclic oxidation from ambient temperature up to temperatures of about 1600° F. (871° C.), such as in internal combustion exhaust environments, and which has improved hot workability. Furthermore, the alloy should be suitable for providing an improved aluminum oxide surface which is adherent to the metallic surface under thermal cyclic conditions. It is further desired that the alloy be susceptible to further treatment to provide an improved and texturized aluminum oxide surface to provide more surface area and so as to enable more catalytic materials to be supported on the alloy by the aluminum oxide surface.

The alloy should also be capable of being stabilized or, if need by, or being stabilized with elevated temperature creep strength properties improved.

SUMMARY OF THE INVENTION

Figure 1:
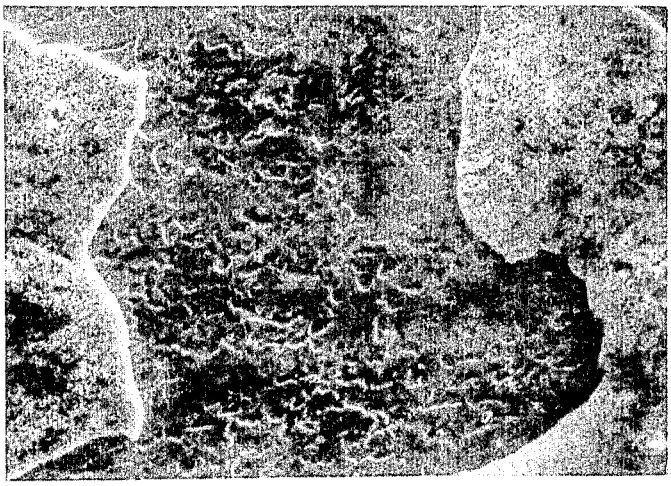
FIGS. 1 and 2 are photomicrographs of alloys which do not satisfy the present invention.

In accordance with the present invention, a hot workable ferritic stainless steel alloy is provided which is resistant to thermal cyclic oxidation and scaling at elevated temperatures and is suitable for forming thereon an adherent textured aluminum oxide surface. The alloy consists essentially of, by weight, 8.0–25.0% chromium, 3.0–8.0% aluminum, and an addition of at least 0.002% and up to 0.05% from the group consisting of cerium, lanthanum, neodymium and praseodymium with a total of all rare earths up to 0.06%, up to 4.0% silicon, 0.06% to 1.0% manganese and normal steelmaking impurities of less than 0.050% carbon, less than 0.050% nitrogen, less than 0.020% oxygen, less than 0.040% phosphorus, less than 0.030% sulfur, less than 0.50% copper, less than 0.50% nickel and the sum of calcium and magnesium less than 0.005%, the remainder being iron.

The alloy may also be stabilized with zirconium or with niobium, the latter used to stabilize and provide elevated temperature creep strength.

An oxidation resistant catalytic substrate having an adherent aluminum oxide surface thereon is also provided as well as a catalytic system including the catalytic substrate. A method of making a hot workable ferritic stainless steel is also provided which includes the steps of preparing a melt of the alloy and thereafter producing an aluminum-bearing ferritic stainless steel from the melt, and then treating the steel to form an adherent textured aluminum oxide surface.

DETAILED DESCRIPTION OF THE PREFERRED EMBODIMENTS

In general, there is provided an iron-chromium-aluminum alloy with rare earth additions, particularly cerium and/or lanthanum, which provides a hot workable alloy which is resistant to thermal cyclic oxidation and scaling at elevated temperatures and suitable for forming thereon an adherent textured aluminum oxide surface.

As used herein, all composition percentages are percent by weight.

The chromium level may range from 8.0–25.0%, and preferably 12.0–23.0%, in order to provide the desired properties such as corrosion and oxidation resistance. The level of chromium is limited to avoid unnecessary hardness and strength which would interfere with the formability of the alloy. Chromium levels less than 8% tend to provide inadequate thermal cyclic oxidation resistance. The chromium alloying element is primarily responsible for providing the corrosion resistance, contributes essentially to oxidation resistance and, as shown in the Tables herein, there is a correlation between the number of thermal cycles to failure and the increase in chromium content. Above 25% chromium, however, increases in the wire life become minimal on balance with the increasing difficulty in fabrication of the alloys.

The aluminum content in the alloy provides increased oxidation resistance at elevated temperatures, reduces the amount of overall chromium needed and tends to increase the resistance to scaling. Aluminum is necessary in the alloy to provide a source for the formation of the alumina (aluminum oxide-$Al_2O_3$) surface. Furthermore, it has been found that there is a correlation between the increasing aluminum content and the increasing thermal cyclic oxidation resistance of the alloy. Generally, aluminum is present in the alloy ranging from about 3.0–8.0%. Below about 3% and at about 2.5%, the cyclic oxidation resistance tends to become unacceptably low. Furthermore, at high aluminum contents, the ability to form a uniformly texturized aluminum oxide surface, such as "whiskers", becomes erratic, such that at values above 8%, there is a marked decline in the ability to texturize the aluminum oxide surface, i.e., form alumina whiskers.

It also appears that the aluminum content at which acceptable oxidation resistance and cyclic oxidation resistance is achieved is a function of the chromium content of the alloy. Higher aluminum levels are required at lower chromium levels. The minimum aluminum content at which suitable oxidation resistance begins can be expressed as $$\%\ Cr + 6\ (\%\ Al) = 40$$

or as $$\%\ Al = \frac{(40 - \%\ Cr)}{6}.$$

Preferably, aluminum ranges from a minimum calculated by the above formula up to about 8%. More preferably, aluminum may range from 4 to 7%.

Rare earth metal additions are essential to the adherence of the aluminum oxide surface. Rare earth metals suitable for the present invention may be those from the lanthanon series of 14 rare earth elements. A common source of the rare earths may be as mischmetal which is a mixture primarily of cerium, lanthanum, neodymium, praseodymium and samarium with trace amounts of 10 other rare earth metals. Preferably, the alloy contains at least additions of cerium or lanthanum, or a combination of them, to assure adherence of the alumina scale and to provide a scale which is characterized by its ability to be texturized and subjected to a growth of alumina whiskers. The rare earth addition can be made in the form of pure cerium metal, pure lanthanum metal, or a combination of those metals. As rare earth metals are difficult to separate from one another, mischmetal, the relatively inexpensive mixture of rare earth elements, may be utilized as an alloying addition.

Preferably, the alloy of the present invention contains a rare earth metal addition in metal form of at least about 0.002% from the group consisting of cerium, lanthanum, neodymium and praseodymium. More preferably, the alloy contains an addition of at least about 0.002% from the group consisting of cerium and lanthanum and a total content of the rare earth metals cerium and lanthanum not to exceed 0.5%. When rare earth metals other than cerium, lanthanum, neodymium and praseodymium are present, the total of all rare earth metals should not exceed about 0.06% and preferably, not exceed 0.05%. It appears that greater levels of rare earth metals have little tendency to improve the resistance to oxidation and scaling or the adherence of oxide scale, while it does tend to make the alloys unworkable at normal steel hot working temperatures of about 1900°-2350° F. (1038°-1288° C.).

Even more preferably, the cerium and/or lanthanum content should range from a lower limit which is proportional to the chromium content of the steel. It has been found that the cerium and/or lanthanum content may range from a lower limit expressed as $$\frac{\%\ Cr}{2200}.$$

An optimum total amount of rare earths in the alloy appears to be about 0.02%.

It is desirable to keep normal steelmaking impurities at relatively low levels. The alloy of the present invention, however, does not require special raw material selection or melting processes such as vacuum induction melting to maintain such impurities at extremely low levels. The alloy of the present invention can be satisfactorily made by using electric arc furnaces or AOD (argon-oxygen-decarburization) processes. The rare earth metals show a strong affinity for combination with nitrogen, oxygen and sulfur which are normal impurities in the steelmaking processes. That portion of the rare earth additions which combine with such elements is effectively removed from the metallic alloy and become unavailable for contributing to adherence of the aluminum oxide surface and any textured or whisker growth thereon. For that reason, it is desirable to have the content of these elements in the molten alloy bath as low as possible before making the rare earth additions.

Methods for reducing carbon and nitrogen contents are well known and such conventional methods are applicable to the present invention. Carbon levels may range from up to 0.05% and, preferably, up to 0.03% with a practical lower limit being 0.001%. Nitrogen levels may range up to 0.05% and, preferably, up to 0.03% with a practical lower limit being 0.001%.

Methods for reducing oxygen and sulfur content are also well known and such conventional methods are applicable to the present invention. Oxygen content may range from up to 0.20% and, preferably, up to 0.01% with a practical lower limit being 0.001%. Sulfur levels may range up to 0.03%. Preferably sulfur may range up to 0.02% with a practical lower limit being 0.0005%.

Conventional processes for reduction of oxygen and sulfur content will sometimes involve the use of additions of calcium or magnesium and may leave residual quantities of these elements in the alloy. Calcium and magnesium are strong deoxidizing and desulfurizing elements and it is desirable to keep them low. The sum of calcium and magnesium may range up to 0.005% and, preferably, up to 0.003%. It has been found that such deoxidizing additions, whether residual content of calcium or magnesium remain in the analysis or not, do not adversely affect the thermal cyclic oxidation resistance or aluminum oxide adherence or texturizing and whisker growth of the oxide surface.

Another normal steelmaking impurity is phosphorus which may be present up to 0.04% and, preferably, up to 0.03% with a practical lower limit being about 0.001%.

Copper and nickel are two other normal steelmaking impurities. Nickel should be less than 1.0% and, preferably, less than 0.4% with a typical lower limit being 0.001%. Copper also should be maintained at a level of less than 0.5% and, preferably, less than 0.4% with a practical lower limit being about 0.005%. To provide for copper and nickel contents of less than the lower limit would have no effect on the ordered properties, but would be difficult to achieve without special melting techniques and specific raw material selection.

Silicon may be present in amounts up to 4.0% and, preferably, up to 3.0%. The presence of silicon generally tends to improve the general oxidation resistance and improves the fluidity of the molten alloy and, thus, improves the ability to cast the alloy into thin sections. Silicon is an element commonly used for deoxidation in the production of steel and appears to have a neutral or only slightly beneficial effect upon oxide adherence and can be tolerated up to about 4% without interfering with texturizing of the aluminum oxide surface and the formation of alumina whiskers. Preferably, the silicon content is kept below 3% for the production of wrought products, because silicon contributes to the brittleness of the alloy during cold working. The embrittlement effect is most noticeable when the chromium content is below 14%. Such amounts of silicon can be included in the alloy without adversely affecting the hot workability of the alloy.

Manganese levels may range up to 1% and, preferably, up to 5.0% with a lower limit being 0.06% and preferably 0.10%. Such manganese levels provide for efficient fabrication and avoid unnecessary hardness and strength which could interfere with the formability and hot workability of the alloy. Manganese levels greater than 1% do not appear to contribute to the desired properties of the alloy. Manganese below 0.06% tends to contribute to nonuniform texturizing of whisker growth of the oxide surface.

Anticipated use of the alloy of the present invention is in cyclic high temperature environments such as may be found in catalytic converters and electrical resistance heating elements. As a result of heating and cooling slowly through a temperature range such as 900°-1300° F. (482°-704° C.), grain boundary sensitization can take place. Such sensitization can reduce the corrosion and oxidation resistance of ferritic stainless steel substrate materials. The addition of stabilizing elements which are strongly attracted to carbon to prevent sensitization are also well known. However, stabilizing elements, particularly in percentages far above those necessary for theoretical stabilization as those elements are normally added to stainless steels, will adversely affect thermal cyclic oxidation resistance of the alloy. It has been found that the more common stabilization elements, such as titanium, zirconium, niobium and vanadium, have different effects on thermal cyclic oxidation resistance. Titanium appears to have the most adverse effect, while zirconium, at low percentages, has a neutral or slightly beneficial effect. It is generally preferred to have only one stabilizing element in the alloy. Combinations of stabilizing elements are generally not desirable, as the effect of the combined additions is approximately that of an equivalent addition of the element having the more adverse effect on thermal cyclic oxidation resistance. In the present alloy for stabilization, the preferred element is zirconium which may be added in amounts up to $$91\left[\left(\frac{\%\,C}{12}\right)+\left(\frac{\%\,N}{14}\right)+0.004\right]\%.$$

Preferably, zirconium may range up to $$91\left[\left(\frac{\%\,C}{12}\right)+\left(\frac{\%\,N}{14}\right)+0.003\right]\%.$$

When zirconium is added to the alloy as a stabilizing element in amounts greater than that required for the above formula, the thermal cyclic oxidation resistance is adversely affected. Similarly, such excessive amounts of zirconium do not improve the elevated temperature creep strength after high temperature annealing.

Of the most common stabilization elements used for providing improved elevated temperature creep strength after high temperature annealing, the preferred element is niobium, for it appears to have the least adverse effect on thermal cyclic oxidation resistance. When stabilization and improved elevated temperature creep resistance are required, the alloy may contain niobium in amounts up to $$93\left[\left(\frac{\%\,C}{12}\right)+\left(\frac{\%\,N}{14}\right)+0.013\right]\%$$

or preferably up to $$93\left[\left(\frac{\%\,C}{12}\right)+\left(\frac{\%\,N}{14}\right)+0.0075\right]\%.$$

Amounts of niobium in excess of the amounts required for the above formula will not sufficiently improve the elevated temperature creep resistance without having a great adverse effect on the thermal cyclic oxidation resistance.

In making the alloy of the present invention, a melt of the alloy is prepared in a conventional manner. Preferably, the normal steelmaking impurities of oxygen, nitrogen and sulfur are reduced prior to additions of rare earths of the melt. No particular process is required for the alloy of the present invention and, thus, any conventional process, including electric arc furnaces, AOD and vacuum induction melting processes, are acceptable.

The melt can then be cast into ingots, bars, strips or sheets. The steel can be subsequently hot and/or cold rolled and subjected to conventional processes such as descaling and heating prior to fabrication into the desired shape.

The ferritic stainless steel of the present invention can then be heat treated to form an aluminum oxide surface, which is adherent and provides for thermal cyclic oxidation resistance. Preferably, the oxide surface is a textured surface which increases the surface area and facilitates support for catalytic materials. A suitable process for texturizing the aluminum oxide surface may be one for growing dense aluminum oxide "whiskers" substantially generally perpendicular to the metal surface. The "whiskers" provide a brush-like surface to effectively support catalytic materials.

Two processes are known for producing alumina whiskers on iron-chromium-aluminum alloys to further increase the surface area and provide more effective catalyst retention on the surface for improving catalyst efficiency, and the processes include basically either:

1. Producing a thin strip with a heavily cold worked surface by removing the strip from a solid log through a machining process called "peeling" and subjecting said strip to 870° C. to 930° C. in air, as disclosed in United Kingdom Patent Application GB No. 2,063,723A; or 2. Using a thin strip produced by conventional hot and cold rolling, preconditioning the surface by heating for a short time to temperatures of about 900° C. in an essentially oxygen-free inert atmosphere ($<0.1\%$ $O_2$) and after cooling to room temperature following which a whisker growing heat treatment in air for longer periods of time at about 925° C.

In order to more completely understand the present invention, the following examples are presented.

EXAMPLES

The alloys of the present invention shown in the following Tables I through IV are made by alloying the elements in a molten state. Most of the alloys shown in the four Tables were melted by vacuum induction processes into 17 or 50-pound heats. Generally, the ingots were heated to about 2250° F. (1232° C.) for pressing or hot rolling to bars four to five inches wide (10.16 to 12.70 centimeters) and one to two inches (2.54 to 5.08 centimeters) thick. The bars were then either cooled to room temperature for conditioning or were directly reheated to the temperature range 2100° to 2350° F. (1147° to 1232° C.) for hot rolling to strip material approximately 0.11 inch (0.28 centimeters) thick. The strip was descaled, conditioned as necessary and cold rolled to 0.004 inch or 0.020 inch (0.010 or 0.051 centimeters) thick. Some of the strip was preheated to 300°-500° F. (149° to 260° C.) before cold rolling if such preheating was necessary. The strip was then annealed at about 1550° F. (843° C.), descaled and again cold rolled to foil of about 0.002 inch (0.005 centimeters) thick.

The clean and cold-rolled samples of foil strip were then treated in accordance with the above-described Process 2 for the purpose of growing dense alumina whiskers on the foil surface. The samples were then examined for whisker growth, uniformity and adherence under a scanning electron microscope (SEM) to 100 to 10,000 magnifications.

In the Tables, the ability of the heats to grow whiskers is indicated in the column headed "Whiskers". An "OK" symbol indicates the ability to grow dense adherent whiskers uniformly distributed over the whole surface. Negative exponents or minus signs following the term "OK" indicate a degree of non-uniformity of the whiskers at lower magnifications ranging from 100 to 1000. The column may also include comments about the shape or configuration of the whiskers, such as "Fine", "Coarse", "Short", "Medium", "Long", "Short Rosettes", "Very Short Rosettes", "Flaked" and "Slight Flake". If a sample was not workable, an indication is made in the "Whisker" column. Under the column entitled "Wire Life", the results of more than one test may be indicated and are reported as the number of cycles to failure.

The wire life tests were conducted in an ASTM wire life tester generally in accordance with the procedure outlined in Specification B 78-59 T. The tester essentially consists of a controlled power supply for resistance heating of the sample by an electrical current, a temperature measuring device and a counter to record the number of heating and cooling cycles which the sample undergoes before failing by rupture. Samples of the heats were prepared by cutting about 3/16-inch wide and 6-inches long (0.476 centimeters and 15.24 centimeters) from the 0.002-inch thick foil. The samples were attached to the wire life tester and subjected to thermal cyclic conditions. The cycle imposed on all samples or specimens was heating to 2300° F. (1260° C.), holding for two minutes at that temperature, cooling to ambient temperature, holding for two minutes at ambient temperature, and repeating the cycle until failure of the specimen by rupture. The testing procedure departed from the standard ASTM procedure by the use of a rectangular foil section to replace round wire and the use of 2300° F. instead of 2200° F. (1204° C.) as the heating temperature in order to decrease the time for testing.

It is accepted that the wire life test is directly related to performance in electrical resistance heating element applications. The test is also expected to show a relationship to catalyst substrate uses as a method of evaluating resistance to oxidation at high temperatures and retention of adherent oxides under thermal cyclic conditions. Normally, flaking of oxide at the point of failure preceded actual failure in the test. Alumina whiskers were not developed during the wire life testing. As part of the analysis of the data, heats having a wire life below 80 cycles were considered to be undesirable.

TABLE I

16% Cr Heats

| Heat No. | Cr | Al | Ce | La | Nd | Pr | C | Mn | P | S | Si | Y | Total RE |
|---|---|---|---|---|---|---|---|---|---|---|---|---|---|
| RV7458 | 15.98 | 5.12 | | | | | 0.0054 | 0.21 | | 0.002 | 0.30 | 0.41 | |
| RV7517 | 15.85 | 5.21 | | | | | 0.0036 | 0.006 | 0.009 | 0.001 | 0.33 | 0.34 | |
| RV8523 | 15.93 | 5.41 | | | | | 0.020 | 0.18 | 0.001 | 0.003 | 0.32 | <0.001 | |
| RV8536 | 16.19 | 5.18 | | 0.020 | | | 0.022 | 0.22 | 0.001 | 0.002 | 0.40 | | 0.020+ |
| RV8537 | 16.19 | 5.25 | | 0.016 | | | 0.020 | 0.23 | 0.001 | 0.001 | 0.25 | | 0.016+ |
| RV8540 | 16.05 | 5.30 | | 0.020 | | | 0.028 | 0.23 | 0.001 | 0.001 | 0.27 | | 0.020+ |
| RV8608 | 16.12 | 5.18 | 0.004 | 0.029 | | | 0.022 | 0.23 | 0.005 | 0.005 | 0.28 | | 0.033+ |
| RV8765 | 16.30 | 4.80 | | 0.001 | | | 0.016 | 0.15 | 0.003 | 0.001 | 0.23 | | 0.001+ |
| RV8766 | 16.26 | 5.63 | 0.051 | 0.020 | 0.017 | 0.004 | 0.018 | 0.14 | 0.002 | 0.0007 | 0.27 | | 0.092 |
| RV8769 | 16.28 | 4.97 | 0.058 | 0.030 | 0.024 | 0.008 | 0.018 | 0.15 | 0.005 | 0.0008 | 0.27 | | 0.120 |
| RV8770 | 16.16 | 5.85 | 0.009 | 0.006 | 0.004 | 0.001 | 0.018 | 0.15 | 0.003 | 0.0016 | 0.27 | | 0.020 |
| RV8773 | 16.42 | 4.85 | 0.030 | 0.012 | 0.011 | 0.004 | 0.015 | 0.15 | 0.005 | 0.0009 | 0.26 | | 0.057 |
| RV8774 | 16.20 | 5.71 | 0.026 | 0.012 | 0.014 | 0.004 | 0.013 | 0.15 | 0.006 | 0.0004 | 0.25 | | 0.056 |
| RV8792 | 16.21 | 4.96 | 0.003 | 0.003 | 0.0005 | Nil | 0.0011 | 0.15 | 0.002 | 0.001 | 0.24 | | 0.0065 |
| RV8793 | 16.05 | 5.66 | 0.017 | 0.008 | 0.004 | 0.002 | 0.0069 | 0.15 | 0.003 | 0.0008 | 0.24 | | 0.031 |
| RV8797 | 16.00 | 5.66 | 0.013 | 0.005 | 0.004 | 0.0005 | 0.013 | 0.15 | 0.003 | 0.0015 | 0.24 | | 0.023 |
| RV8901 | 15.97 | 6.50 | 0.007 | 0.003 | | | 0.018 | 0.32 | 0.023 | 0.001 | 0.40 | | 0.010+ |
| RV8902 | 16.05 | 6.45 | 0.009 | 0.005 | | | 0.012 | 0.34 | 0.024 | 0.002 | 0.40 | | 0.014+ |
| RV8903 | 15.95 | 6.47 | 0.009 | 0.004 | | | 0.027 | 0.31 | 0.023 | 0.001 | 0.41 | | 0.013+ |
| RV8904 | 16.08 | 6.48 | 0.008 | 0.005 | | | 0.024 | 0.47 | 0.023 | 0.001 | 0.41 | | 0.013+ |
| RV9027A | 15.21 | 5.06 | 0.013 | 0.0042 | 0.0059 | 0.0068 | 0.022 | 0.43 | 0.034 | 0.002 | 0.41 | | 0.0299 |
| RV9027B | 15.06 | 5.85 | 0.013 | 0.0044 | 0.0072 | 0.0062 | 0.022 | 0.43 | 0.034 | 0.002 | 0.41 | | 0.0309 |
| RV9027C | 14.89 | 6.55 | 0.011 | 0.0033 | 0.0054 | 0.0044 | 0.022 | 0.42 | 0.035 | 0.002 | 0.40 | | 0.0241 |

| Heat No. | Stabilizer | Other | Whiskers | Wire Life |
|---|---|---|---|---|
| RV7458 | | 0.001 Ca | OK | 173/203 |
| RV7517 | | 0.18 Ni; 0.0044 Ca | OK | 137/155 |
| RV8523 | | | OK — Mixed Fine and Coarse - Flaked | 82/170 |
| RV8536 | | | OK — Blades | 146/204 |
| RV8537 | | | OK — Blades | 96/158 |
| RV8540 | 0.13 Ti | | OK — Blades | 161/178 |
| RV8608 | 0.041 Zr | | OK — Blades | 180/214 |
| RV8765 | | | Flaked | 51/60 |
| RV8766 | | | Not Workable | |
| RV8769 | 0.07 Zr | | Not Workable | |
| RV8770 | 0.10 Zr | | OK - | 195 |
| RV8773 | 0.18 Zr | | Not Workable | |
| RV8774 | 0.03 Zr | | Not Workable | |
| RV8792 | 0.003 Zr | | OK | 74/74 |
| RV8793 | | 0.0002 Ca | OK | 193/236 |
| RV8797 | 0.34 Zr | | OK | 241/284 |
| RV8901 | 0.07 Zr | 0.14 Ni; 0.04 Cu; Nil Ca | OK - | 216/246 |
| RV8902 | 0.07 Zr | 0.26 Ni; 0.17 Cu; Nil Ca | OK - | 272 |
| RV8903 | 0.06 Zr | 0.50 Ni; 0.17 Cu; Nil Ca | OK - | 333/374 |
| RV8904 | 0.06 Zr | 0.50 Ni; 0.17 Cu; Nil Ca | OK - | 226/280 |
| RV9027A | | 0.19 Ni; 0.15 Cu; 0.048 Mo | OK Coarse | 120/117 |
| RV9027B | | 0.19 Ni; 0.15 Cu; 0.049 Mo | OK - Coarse | 161/143 |
| RV9027C | | 0.19 Ni; 0.15 Cu; 0.050 Mo | OK - Coarse | 193/165 |

Figure 2:
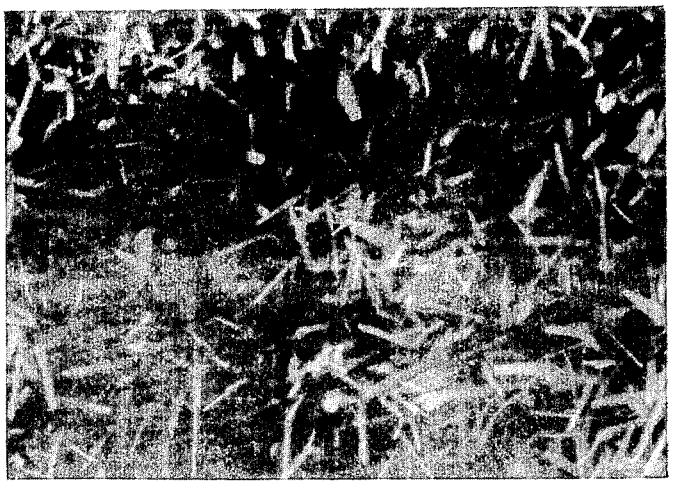

The heats of Table I are nominally 16% chromium and 5% aluminum alloys. Heats RV7458 and RV7517 are typical of iron-chromium-aluminum-yttrium alloys that have been considered for catalytic substrates. Heats RV8523 and RV8765 without significant yttrium or rare earth additions showed flaking of the oxide whisker surface and reduced wire life. FIG. 1 is a photomicrograph at 500X magnification of a sample at Heat RV8765 which shows that the surface oxide had poor adherence and easily flaked off. FIG. 2 is a photomicrograph at 5000X magnification of the same sample which shows that a whiskered oxide surface was formed, although it was not adherent.

Heats RV8536, RV8537, RV8540 and RV8608 were melted with additions of lanthanum metal and show that this element, by itself, is effective in providing the desired oxide adherence.

Heats RV8766, RV8769, RV8773 and RV8774 all have rare earth content above 0.05% and all were found to break up during hot working. Heat RV8770 with near optimum cerium and lanthanum content and partial stabilization with zirconium can be hot and cold worked to produce foil exhibiting acceptable properties. Heat RV8792 with lower cerium and lanthanum and insignificant zirconium stabilization content shows acceptable whisker growth but marginal wire life.

Heats RV8793 and RV8797 were melted using a cerium-nickel alloy for the rare earth addition. Acceptable whisker growth and wire life were obtained both with and without zirconium stabilization. Heats RV8901 through RV8904 with relatively high aluminum content and residual element (Ni, Cu, Si, Mn, P, S) contents typical of those obtained in electric furnace or AOD processing had an addition of calcium-aluminum made prior to the addition of rare earths in the form of mischmetal. These heats all show acceptable whisker growth and adherence and excellent wire life.

The rare earth additions to Heats RV9027A through C were made in the form of mischmetal. In this series of heats, it can be seen that although acceptable, the uniformity of whisker growth decreases and the wire life increases as aluminum content is increased.

TABLE II

21% Cr Heats

| Heat No. | Cr | Al | Ce | La | Nd | Pr | C | Mn | P | S | Si | Total RE |
|---|---|---|---|---|---|---|---|---|---|---|---|---|
| RV8442 | 21.30 | 5.82 | 0.0165 | 0.0092 | 0.0069 | 0.0017 | 0.015 | 0.13 | 0.002 | 0.002 | 0.23 | 0.036 |
| RV8767 | 21.05 | 4.90 | 0.063 | 0.063 | 0.025 | 0.006 | 0.014 | 0.14 | 0.004 | 0.0012 | 0.26 | 0.126 |
| RV8768 | 21.90 | 5.77 | 0.005 | 0.003 | 0.002 | 0.001 | 0.017 | 0.15 | 0.005 | 0.0016 | 0.26 | 0.011 |
| RV8771 | 21.08 | 4.45 | 0.002 | 0.0005 | 0.0005 | Nil | 0.008 | 0.15 | 0.006 | 0.0001 | 0.26 | 0.003 |
| RV8772 | 20.80 | 6.01 | 0.046 | 0.018 | 0.018 | 0.004 | 0.014 | 0.16 | 0.005 | 0.0001 | 0.28 | 0.088 |
| RV8775 | 20.97 | 5.03 | 0.016 | 0.005 | 0.006 | 0.002 | 0.013 | 0.14 | 0.006 | 0.0006 | 0.27 | 0.029 |
| RV8776 | 21.18 | 5.63 | 0.030 | 0.013 | 0.014 | 0.003 | 0.010 | 0.14 | 0.005 | 0.0007 | 0.27 | 0.060 |
| RV8794 | 20.90 | 4.94 | 0.018 | 0.008 | 0.005 | 0.002 | 0.0086 | 0.15 | 0.003 | 0.0011 | 0.25 | 0.032 |
| RV8795 | 21.23 | 5.66 | 0.008 | 0.004 | 0.002 | Nil | 0.017 | 0.15 | 0.002 | 0.002 | 0.23 | 0.014 |
| RV8798 | 21.08 | 4.98 | 0.009 | 0.003 | 0.003 | Nil | 0.011 | 0.16 | 0.004 | 0.0011 | 0.24 | 0.015 |
| RV8825A | 21.90 | 5.04 | 0.016 | 0.0091 | | | 0.019 | 0.38 | 0.028 | 0.002 | 2.00 | 0.0251+ |
| RV8825B | 21.50 | 5.00 | 0.011 | 0.0054 | | | 0.025 | 0.37 | 0.029 | 0.003 | 3.03 | 0.0164+ |
| RV8825C | 21.35 | 5.00 | 0.007 | 0.0038 | | | 0.066 | 0.38 | 0.028 | 0.002 | 3.91 | 0.0108+ |
| RV8849A | 21.89 | 3.20 | 0.018 | 0.007 | | | 0.021 | 0.41 | 0.036 | 0.001 | 1.98 | 0.025+ |
| RV8849B | 21.53 | 3.16 | 0.010 | 0.002 | | | 0.021 | 0.40 | 0.036 | 0.001 | 3.09 | 0.012+ |
| RV8849C | 21.42 | 3.15 | 0.006 | 0.001 | | | 0.023 | 0.40 | 0.036 | 0.001 | 3.08 | 0.007+ |
| RV8867 | 21.18 | 5.46 | 0.010 | 0.003 | 0.003 | 0.0006 | 0.0039 | 0.16 | 0.005 | 0.0001 | 0.27 | 0.017 |
| RV8869 | 21.10 | 5.69 | 0.018 | 0.005 | 0.007 | 0.002 | 0.0021 | 0.15 | 0.006 | 0.0001 | 0.27 | 0.032 |
| RV8871 | 21.20 | 5.50 | 0.011 | 0.003 | 0.004 | 0.001 | 0.008 | 0.15 | 0.006 | 0.0001 | 0.26 | 0.019 |
| RV8873 | 21.22 | 5.67 | 0.023 | 0.008 | 0.009 | 0.003 | 0.003 | 0.15 | 0.006 | 0.0001 | 0.26 | 0.043 |
| RV8898 | 21.81 | 5.77 | 0.007 | 0.002 | | | 0.012 | 0.35 | 0.027 | 0.002 | 0.32 | 0.009+ |
| RV8899 | 21.82 | 5.76 | 0.009 | 0.005 | | | 0.024 | 0.33 | 0.024 | 0.002 | 0.32 | 0.014+ |
| RV8900 | 22.03 | 5.70 | 0.009 | 0.004 | | | 0.016 | 0.49 | 0.026 | 0.001 | 0.33 | 0.013+ |
| RV8910 | 21.52 | 5.82 | 0.003 | 0.005 | | | 0.022 | 0.17 | 0.004 | 0.002 | 0.39 | 0.008+ |
| RV8911 | 21.58 | 5.76 | 0.011 | 0.003 | | | 0.031 | 0.18 | 0.007 | 0.002 | 0.36 | 0.014+ |
| RV8912 | 21.60 | 5.78 | 0.009 | 0.002 | | | 0.033 | 0.18 | 0.004 | 0.002 | 0.31 | 0.011+ |
| RV8913 | 21.80 | 5.76 | 0.0091 | 0.0039 | 0.004 | 0.001 | 0.030 | 0.17 | 0.004 | 0.001 | 0.33 | 0.018 |
| RV8945 | 20.80 | 6.45 | 0.038 | 0.001 | | | 0.030 | <0.005 | 0.003 | 0.001 | 0.30 | 0.039+ |
| RV8946 | 20.86 | 6.62 | 0.024 | 0.001 | | | 0.017 | <0.005 | 0.003 | 0.003 | 0.30 | 0.025+ |
| RV8947 | 20.83 | 6.59 | 0.021 | 0.001 | | | 0.030 | <0.005 | 0.003 | 0.003 | 0.30 | 0.022+ |
| RV8948 | 20.82 | 6.53 | 0.003 | 0.039 | | | 0.019 | <0.005 | 0.003 | 0.003 | 0.31 | 0.041+ |
| RV8949 | 20.80 | 6.56 | 0.002 | 0.027 | | | 0.030 | <0.005 | 0.003 | 0.004 | 0.25 | 0.029+ |
| RV8950 | 20.82 | 6.58 | 0.005 | 0.013 | | | 0.020 | <0.005 | 0.003 | 0.003 | 0.31 | 0.0135+ |
| RV8955 | 20.69 | 5.79 | 0.023 | 0.007 | 0.007 | 0.0025 | 0.008 | 0.065 | 0.003 | 0.002 | 0.31 | 0.0395 |
| RV8956 | 20.62 | 5.85 | 0.048 | 0.001 | 0.0011 | 0.0013 | 0.027 | 0.056 | 0.003 | 0.002 | 0.32 | 0.0514 |
| RV8957 | 20.68 | 5.82 | 0.0023 | 0.028 | 0.0005 | 0.0008 | 0.025 | 0.061 | 0.003 | 0.002 | 0.32 | 0.0316 |
| RV8958 | 20.59 | 5.77 | 0.0021 | 0.033 | 0.0006 | 0.0009 | 0.028 | 0.057 | 0.003 | 0.003 | 0.31 | 0.0366 |
| RV8959 | 20.84 | 5.83 | 0.0095 | 0.0052 | 0.0038 | 0.0016 | 0.023 | 0.061 | 0.005 | 0.003 | 0.32 | 0.0201 |
| RV8960 | 20.62 | 5.88 | 0.0071 | 0.0040 | 0.0029 | 0.0010 | 0.023 | 0.057 | 0.002 | 0.002 | 0.31 | 0.0150 |
| RV8961 | 20.68 | 5.73 | 0.0090 | 0.0053 | 0.0035 | 0.0005 | 0.026 | 0.063 | 0.002 | 0.003 | 0.32 | 0.0183 |
| RV8962 | 20.59 | 5.87 | 0.0045 | 0.0029 | 0.0022 | 0.0003 | 0.022 | 0.063 | 0.002 | 0.003 | 0.32 | 0.0097 |
| XW33 | 20.89 | 5.32 | 0.003 | 0.001 | | | 0.030 | 0.18 | 0.003 | 0.003 | 0.53 | 0.004+ |
| 011563E | 19.80 | 5.55 | 0.022 | 0.009 | 0.008 | 0.0035 | 0.015 | 0.40 | 0.012 | 0.002 | 0.31 | 0.0425 |

| Heat No. | Stabilizer | Other | Whiskers | Wire Life |
|---|---|---|---|---|
| RV8442 | 0.049 Zr | | OK | 322/408/481/535 |
| RV8767 | | | Not Workable | |
| RV8768 | | | OK | 181/240 |
| RV8771 | 0.08 Zr | | OK | 217/255 |
| RV8772 | 0.12 Zr | | Not Workable | |
| RV8775 | 0.022 Zr | | OK - | 236/274 |
| RV8776 | 0.11 Zr | | Not Workable | |
| RV8794 | | 0.0002 Ca | OK - | 270 |
| RV8795 | 0.003 Zr | | OK | 112/113 |
| RV8798 | 0.37 Zr | | OK - | 147/181 |
| RV8825A | | 0.03 Ni; 0.015 Cu | OK | 265/211 |
| RV8825B | | 0.027 Ni; 0.015 Cu | OK | 180/156 |
| RV8825C | | 0.031 Ni; 0.016 Cu | OK | 133/91 |
| RV8849A | | 0.024 Ni; 0.017 Cu | OK | 121/119 |
| RV8849B | | 0.026 Ni; 0.018 Cu | OK | 164/111 |
| RV8849C | 0.61 Nb | 0.027 Ni; 0.019 Cu | OK | 174/98 |

TABLE II-continued

| 21% Cr Heats | | | | |
|---|---|---|---|---|
| RV8867 | | | OK | 241/147 |
| RV8869 | | | OK | 248/309 |
| RV8871 | | | OK - | 254/263 |
| RV8873 | | | OK - | 276/239 |
| RV8898 | 0.07 Zr | 0.26 Ni; 0.04 Cu | OK — | 255/306 |
| RV8899 | 0.06 Zr | 0.50 Ni; 0.17 Cu | OK — | 277/375 |
| RV8900 | 0.06 Zr | 0.50 Ni; 0.16 Cu | OK — | 289/337 |
| RV8910 | 0.07 Zr | | OK - | 498/437 |
| RV8911 | 0.06 Zr | | OK - | 464/397 |
| RV8912 | 0.07 Zr | | OK - | 455/601 |
| RV8913 | 0.06 Zr | | OK - | 451/492 |
| RV8945 | | 0.0015 Ca | OK Short Rosettes | 195/226 |
| RV8946 | | 0.0035 Ca | OK - Short Rosettes | 183/185 |
| RV8947 | | 0.0032 Ca | OK Very Short Rosettes | 295/212 |
| RV8948 | | 0.0031 Ca | OK - Very Short Rosettes | 216/216 |
| RV8949 | | 0.0031 Ca | OK - Very Short Rosettes | 320/264 |
| RV8950 | | 0.0021 Ca | OK - Very Short Rosettes | 351/365 |
| RV8955 | | 0.0012 Ca | OK Very Short Rosettes | 418/375 |
| RV8956 | | 0.0025 Ca | Not Workable | |
| RV8957 | | 0.0019 Ca | OK - Very Short | 296/243 |
| RV8958 | | 0.0021 Ca | OK — Very Short | 414/323 |
| RV8959 | | 0.01 Co | OK — Very Short Rosettes | 428/475 |
| RV8960 | | 0.20 Co | OK — Short | 264/189 |
| RV8961 | | 0.43 Co | OK Very Short Rosettes | 236/292 |
| RV8962 | | 0.90 Co | OK - Very Short Rosettes | 290/247 |
| XW33 | 0.10 Zr | | OK | 195/209 |
| 011563E | | 0.24 Ni; 0.10 Cu; 0.02 Mo; 0.02 Co; 0.001 Ca | OK — | 162/163/169/152/215/222 |

Figure 3:
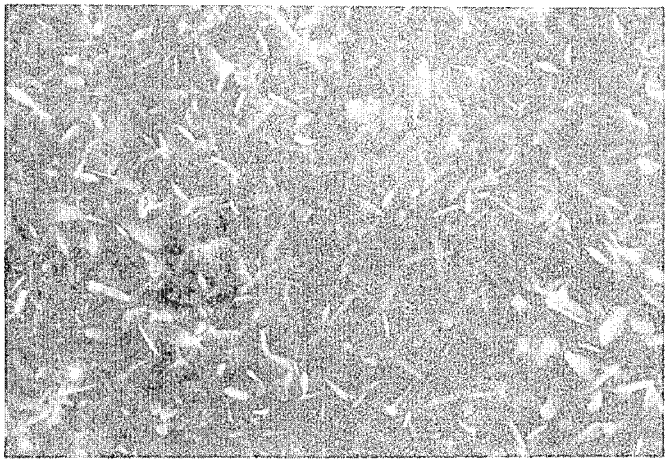
FIGS. 3 and 4 are photomicrographs of alloys of the present invention.

The heats of Table II nominally contain about 21% chromium and 3% to 6% aluminum. Heat RV8442 illustrates the superior whisker growth and wire life of a high chromium alloy of the present invention. FIG. 3 is a photomicrograph of that heat at magnification of 5000X which clearly illustrates the developed adherent whiskered aluminum oxide surface on the alloy.

Heats RV8767, RV8772, RV8776 and RV8956 were found to break up during hot working at normal steel hot working temperatures and, thus, were considered not workable. All four of these heats have a total content of the rare earths cerium, lanthanum, neodymium and praseodymium greater than 0.050%.

Heats RV8768, RV8771, RV8775 and RV8794 illustrate various alloys of the invention, all showing good whisker growth, adherence and wire life as do the low carbon content heats RV8867, RV8869, RV8871 and RV8873 which are also alloys of the invention.

Heats RV8795 and RV8798 are alloys of the invention melted without (RV8795) and with (RV8798) a deliberate zirconium stabilizing addition. Both show good whisker growth, adherence and acceptable wire life and wire life is not decreased as a result of the zirconium addition.

Heats RV8898 through RV8962 are melted using a calcium-aluminum deoxidizing addition before the rare earth addition was made to the melt.

Heats RV8898, RV8899 and RV8900 are alloys of the invention with nickel and copper additions made to approximate high residual contents which are frequently found in conventional melting practice. Acceptable whisker growth, adherence and wire life were found.

Heats RV8910, RV8911, RV8912 and RV8913 are alloys of the invention which, aside from the use of calcium-aluminum deoxidation in these heats, duplicate the alloy of Heat RV8442, both in analysis and in the properties of interest.

Heats RV8945, RV8946, RV8947, RV8955 and RV8956 were melted using cerium metal as the rare earth addition. All of these, with the exception of Heat RV8956, are alloys of the invention and show acceptable whisker growth, adherence and wire life.

Heats RV8948, RV8949, RV8950, RV8957 and RV8958 were melted using lanthanum metal for the rare earth addition. All are alloys of the invention and show acceptable whisker growth, adherence and wire life.

Heats RV8959, RV8960, RV8961 and RV8962 are alloys of the invention using mischmetal for the rare earth addition. Cobalt additions made to Heats RV8960, RV8961 and RV8962 showed no regular effect on whisker growth, adherence or on wire life.

Heats RV8825A, RV8825B, RV8825C, RV8849A, RV8849B and RV8849C are alloys of the invention melted with high silicon content to improve fluidity of the melt and facilitate the casting of thin sections. All show acceptable whisker growth, adherence and wire life. Heat RV8849C illustrates that acceptable properties can be obtained when niobium overstabilization is utilized. The Heats RV8945 through RV8962 all have low manganese content. All of these heats show either the growth of short whiskers or the onset of nonuniform whisker growth as evidenced by formation of rosettes of whiskers.

Heat XW33 is a laboratory induction air melted heat of an alloy of the invention showing acceptable properties.

Heat 011563E is a commercial production size AOD (argon-oxygen-decarburization) heat of an alloy of the invention showing acceptable properties.

TABLE III

| 13% Cr Heats | | | | | | | | | | | | | |
|---|---|---|---|---|---|---|---|---|---|---|---|---|---|
| Heat No. | Cr | Al | Ce | La | Nd | Pr | C | Mn | P | S | Si | N | Total RE |

TABLE III-continued

| 13% Cr Heats | | | | | | | | | | | | | |
|---|---|---|---|---|---|---|---|---|---|---|---|---|---|
| RV7772 | 13.05 | 4.18 | | | | | 0.029 | 0.24 | 0.014 | 0.012 | 0.30 | | |
| RV8885A | 13.13 | 4.21 | 0.008 | | | | 0.020 | 0.44 | 0.027 | 0.001 | 0.34 | 0.014 | 0.008+ |
| RV8885B | 13.03 | 4.13 | Nil | | | | 0.020 | 0.40 | 0.032 | 0.001 | 0.34 | 0.014 | |
| RV8885C | 12.97 | 4.15 | 0.023 | | | | 0.022 | 0.40 | 0.031 | 0.001 | 0.33 | 0.015 | 0.023+ |
| RV8964A | 12.74 | 5.03 | 0.001 | 0.0001 | 0.003 | Nil | 0.019 | 0.37 | 0.033 | 0.004 | 0.33 | 0.013 | 0.0041 |
| RV8964B | 12.72 | 5.11 | 0.019 | 0.009 | 0.010 | 0.0033 | 0.019 | 0.37 | 0.035 | 0.002 | 0.34 | 0.011 | 0.041 |
| RV8964C | 12.61 | 5.00 | 0.013 | 0.0034 | 0.0079 | 0.0022 | 0.018 | 0.36 | 0.033 | 0.002 | 0.33 | 0.013 | 0.0265 |
| RV8965A | 12.99 | 4.03 | Nil | 0.0002 | 0.0002 | 0.0016 | 0.019 | 0.40 | 0.032 | 0.006 | 0.37 | 0.013 | 0.0020 |
| RV8965B | 12.96 | 4.15 | 0.019 | 0.0094 | 0.0069 | 0.0032 | 0.019 | 0.39 | 0.032 | 0.004 | 0.38 | 0.014 | 0.0385 |
| RV8965C | 12.95 | 4.10 | 0.013 | 0.0062 | 0.0049 | 0.0028 | 0.019 | 0.40 | 0.034 | 0.003 | 0.38 | 0.013 | 0.0269 |
| RV8966A | 12.82 | 5.07 | 0.0001 | 0.0003 | 0.0003 | 0.0016 | 0.020 | 0.41 | 0.031 | 0.006 | 0.35 | 0.013 | 0.0023 |
| RV8966B | 12.81 | 5.13 | 0.021 | 0.011 | 0.0076 | 0.0026 | 0.018 | 0.39 | 0.033 | 0.004 | 0.37 | 0.014 | 0.0422 |
| RV8966C | 12.68 | 5.08 | 0.013 | 0.0054 | 0.0074 | 0.0027 | 0.020 | 0.42 | 0.034 | 0.002 | 0.37 | 0.012 | 0.0285 |
| RV8986A | 12.77 | 5.32 | 0.0058 | 0.0025 | 0.0025 | 0.0016 | 0.021 | 0.43 | 0.030 | 0.004 | 0.35 | 0.012 | 0.0124 |
| RV8986B | 12.77 | 5.22 | 0.0051 | 0.0028 | 0.0022 | 0.0012 | 0.022 | 0.42 | 0.028 | 0.004 | 0.35 | 0.0098 | 0.0113 |
| RV8986C | 12.77 | 5.22 | 0.0054 | 0.0029 | 0.0025 | 0.0041 | 0.021 | 0.41 | 0.030 | 0.003 | 0.36 | 0.0113 | 0.0149 |
| RV8987A | 12.98 | 5.37 | 0.0050 | 0.0024 | 0.0028 | 0.0017 | 0.020 | 0.43 | 0.026 | 0.004 | 0.36 | 0.0111 | 0.0119 |
| RV8987B | 12.94 | 5.21 | 0.0064 | 0.0037 | 0.0042 | 0.0025 | 0.020 | 0.43 | 0.029 | 0.003 | 0.37 | 0.0111 | 0.0168 |
| RV8987C | 12.91 | 5.16 | 0.0069 | 0.0024 | 0.0051 | 0.0019 | 0.024 | 0.42 | 0.028 | 0.002 | 0.36 | 0.0106 | 0.0163 |
| RV9000A | 13.90 | 4.99 | Nil | | | | 0.020 | 0.41 | 0.025 | 0.004 | 1.90 | 0.013 | |
| RV9000B | 13.60 | 4.91 | Nil | | | | 0.021 | 0.41 | 0.025 | 0.004 | 2.62 | 0.013 | |
| RV9000C | 13.53 | 4.82 | 0.012 | | | | 0.021 | 0.41 | 0.025 | 0.004 | 2.61 | 0.012 | 0.012+ |
| RV9023A | 13.01 | 6.00 | 0.011 | 0.0026 | 0.0049 | 0.0065 | 0.019 | 0.43 | 0.028 | 0.002 | 0.32 | 0.012 | 0.025 |
| RV9023B | 12.94 | 5.93 | 0.010 | 0.0024 | 0.0050 | 0.0055 | 0.019 | 0.43 | 0.031 | 0.002 | 0.32 | 0.010 | 0.0229 |
| RV9023C | 12.95 | 5.90 | 0.010 | 0.0022 | 0.0048 | 0.0059 | 0.021 | 0.44 | 0.030 | 0.002 | 0.32 | 0.012 | 0.0229 |
| RV9025A | 12.85 | 4.76 | 0.016 | 0.0077 | 0.0090 | 0.0070 | 0.026 | 0.39 | 0.034 | 0.002 | 0.37 | 0.012 | 0.0397 |
| RV9025B | 12.73 | 5.52 | 0.013 | 0.0059 | 0.0071 | 0.0051 | 0.025 | 0.38 | 0.035 | 0.002 | 0.36 | 0.013 | 0.0311 |
| RV9025C | 12.62 | 6.28 | 0.0094 | 0.0041 | 0.0052 | 0.0063 | 0.026 | 0.38 | 0.033 | 0.002 | 0.36 | 0.013 | 0.0250 |

| Heat No. | Stabilizer | Other | Whiskers | Wire life |
|---|---|---|---|---|
| RV7772 | | 0.20 Ni | OK Flaked | 8/9 |
| RV8885A | | 0.23 Ni; 0.03 Cu; 0.055 Mo | OK Slight Flake | 75/76 |
| RV8885B | 0.78 Nb | 0.22 Ni; 0.021 Cu; 0.045 Mo | OK Flaked | 37/24 |
| RV8885C | 0.79 Nb | 0.22 Ni; 0.021 Cu; 0.045 Mo | OK | 42/34 |
| RV8964A | 0.27 Zr; 0.002 Nb | 0.23 Ni; 0.018 Cu; 0.067 Mo | OK - Slight Flake | 157/137 |
| RV8964B | 0.28 Zr; 0.002 Nb | 0.23 Ni; 0.019 Cu; 0.067 Mo | OK | 226/163 |
| RV8964C | 0.28 Zr; 0.30 Nb | 0.23 Ni; 0.019 Cu; 0.066 Mo | OK | 174/113 |
| RV8965A | 0.22 Ti; 0.005 Nb | 0.18 Ni; 0.017 Cu; 0.058 Mo | OK - Slight Flake | 73/84 |
| RV8965B | 0.21 Ti; 0.005 Nb | 0.19 Ni; 0.014 Cu; 0.060 Mo | OK - | 86/119 |
| RV8965C | 0.21 Ti; 0.28 Nb | 0.18 Ni; 0.014 Cu; 0.059 Mo | OK - | 57/63 |
| RV8966A | 0.44 Ti; 0.012 Zr; 0.005 Nb | 0.17 Ni; 0.016 Cu; 0.060 Mo | OK - Slight Flake | 141/89 |
| RV8966B | 0.44 Ti; 0.015 Zr; 0.005 Nb | 0.18 Ni; 0.017 Cu; 0.061 Mo | OK - | 118/93 |
| RV8966C | 0.43 Ti; 0.29 Zr; 0.005 Nb | 0.18 Ni; 0.017 Cu; 0.072 Mo | OK | 32/32 |
| RV8986A | 0.056 V | 0.23 Ni; 0.031 Cu; 0.057 Mo | OK | 87/90 |
| RV8986B | 0.11 V | 0.23 Ni; 0.024 Cu; 0.058 Mo | OK | 85/81 |
| RV8986C | 0.21 V | 0.22 Ni; 0.029 Cu; 0.057 Mo | OK | 81/83 |
| RV8987A | | 0.23 Ni; 0.029 Cu; 0.062 Mo | OK | 74/80 |
| RV8987B | 0.11 Zr | 0.23 Ni; 0.029 Cu; 0.060 Mo | OK | 176/236 |
| RV8987C | 0.22 Zr | 0.23 Ni; 0.029 Cu; 0.062 Mo | OK | 165/227 |
| RV9000A | | 0.47 Ni; 0.031 Cu; 0.22 Mo | Not Workable | |
| RV9000B | | 0.46 Ni; 0.031 Cu; 0.22 Mo | Not Workable | |
| RV9000C | | 0.49 Ni; 0.031 Cu; 0.22 Mo | OK - | 420/327* |
| RV9023A | | 0.024 Ni; 0.16 Cu | OK - | 173/129 |
| RV9023B | | 0.55 Ni; 0.17 Cu | OK - | 137/106 |
| RV9023C | | 0.80 Ni; 0.17 Cu | OK | 158/161 |
| RV9025A | | 0.21 Ni; 0.16 Cu | OK - Short | 82/87 |
| RV9025B | | 0.20 Ni; 0.16 Cu | OK - Medium | 127/89 |
| RV9025C | | 0.21 Ni; 0.16 Cu | OK - Long | 148/133 |

*0.003 inch sample - stiff cold rolling

Figure 4:
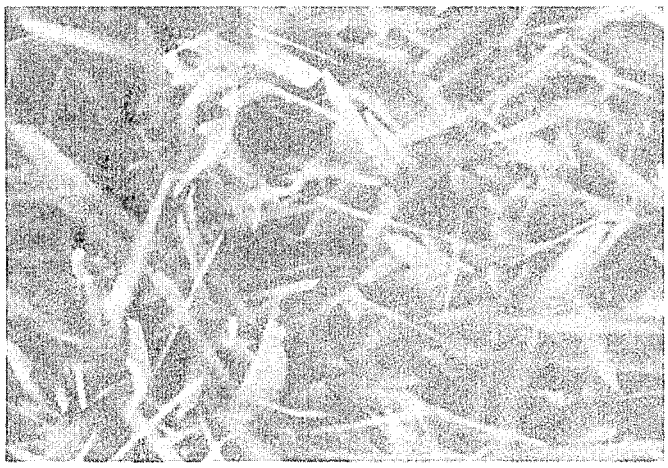

The heats of Table III are nominally 13% chromium and 4% to 6% aluminum. Heat RV7772 was made without rare earth addition and exhibited whisker growth but oxide flaking and low wire life. Heat RV8885A is an alloy of the invention made with a mischmetal addition and low rare earth recovery. Here the flaking was reduced and wire life became marginal. FIG. 4 is a photomicrograph of Heat 8885A at 5000X magnification illustrating the whisker growth. Heat 8885B is a second fraction of the same melt which does not represent an alloy of this invention. Here the rare earth addition was allowed to "fade" until the cerium content became undetectable and a stabilizing addition of niobium was made. Again, the oxide whiskers exhibited poor adherence (flaking) and low wire life. A second rare earth addition in Heat RV8885C restored the whisker adherence but still exhibited low wire life in the presence of niobium overstabilization.

Heats RV8964A, RV8964B and RV8964C have higher aluminum content and zirconium stabilization. Heat RV8964A, melted without intentional rare earth addition, exhibited questionable whisker adherence and acceptable wire life. The unexpectedly high neodymium content may be a contributing factor to whisker adherence. An intentional mischmetal addition was made to Heat RV8964B with a resulting improvement in whisker adherence and wire life. Additional stabilization with niobium in Heat RV8964C produced acceptable whisker adherence and acceptable but reduced wire life test values.

evaluated comparatively because of the greater foil thickness.

TABLE IV

| Low Cr Heats | | | | | | | | | | | | | |
|---|---|---|---|---|---|---|---|---|---|---|---|---|---|
| Heat No. | Cr | Al | Ce | La | Nd | Pr | C | Mn | P | S | Si | N | Total RE |
| RV8983 | 6.99 | 5.26 | 0.0041 | 0.0016 | 0.0014 | 0.0018 | 0.017 | 0.41 | 0.029 | 0.010 | 0.31 | 0.0091 | 0.0089 |
| RV8984 | 9.04 | 5.86 | 0.0077 | 0.0039 | 0.0037 | 0.0019 | 0.017 | 0.43 | 0.026 | 0.003 | 0.35 | 0.0083 | 0.0172 |
| RV8985 | 10.91 | 5.16 | 0.0050 | 0.0021 | 0.0023 | 0.0031 | 0.028 | 0.43 | 0.029 | 0.003 | 0.29 | 0.0115 | 0.0125 |

| Heat No. | Stabilizer | Other | Whiskers | Wire Life |
|---|---|---|---|---|
| RV8983 | 0.20 Ti | 0.23 Ni; 0.029 Cu; 0.055 Mo | OK | 9/5 |
| RV8984 | 0.21 Ti | 0.23 Ni; 0.029 Cu; 0.056 Mo | OK - | 89/33 |
| RV8985 | 0.20 Ti | 0.23 Ni; 0.029 Cu; 0.056 Mo | OK - | 71/76 |

Heats RV8965A, RV8965B and RV8965C were melted with lower aluminum content and titanium stabilization. Heat RV8965A was melted without intentional rare earth addition and exhibited questionable whisker adherence and marginal wire life. Addition of mischmetal to Heat RV8965B resulted in improved whisker adherence and wire life while an additional stabilization addition of niobium to Heat RV8965C resulted in unacceptable wire life without affecting whisker adherence.

Heats RV8966A, RV8966B and RV8966C were melted with higher aluminum content and a higher degree of titanium stabilization. Heat RV8966A, melted without intentional rare earth addition, exhibited questionable whisker adherence and acceptable wire life. A mischmetal addition to Heat RV8966B improved whisker adherence to an acceptable level while maintaining acceptable wire life. Additional niobium stabilization added to Heat RV8966C maintained whisker adherence but produced unacceptable wire life.

Heats RV8986A, RV8986B and RV8986C were used to examine vanadium as a stabilizing element. In each case, although whisker adherence was satisfactory, the wire life values were marginal.

Heats RV8987A, RV8987B and RV8987C were used to examine the effects of zirconium as a stabilizing element. Heat RV8987A melted without zirconium addition shows acceptable whisker adherence and marginal wire life. Zirconium stabilizing additions to Heats RV8987B and RV8987C improved the wire life to acceptable levels without destroying whisker growth or adherence.

Heats RV9023A, RV9023B and RV9023C were used to examine the effect of nickel content in alloys of the invention on whisker growth, adherence and wire life. No significant effect was found, all heats showing acceptable whisker adherence and wire life.

Heats RV9025A, RV9025B and RV9025C were used to examine the effect of aluminum content in 13% chromium alloys of the invention on whisker growth, adherence and wire life. Whisker growth and adherence were acceptable in all three heats, while wire life increased as aluminum content increased.

Heats RV9000A, RV9000B and RV9000C were used to examine the effect of silicon additions which are desirable to improve fluidity when casting thin sections. Heats RV9000A and RV9000B which are not alloys of the invention had no rare earth additions and were found to crack in cold rolling. A mischmetal rare earth addition to Heat RV9000C improved the workability so that cold rolling was possible. The material, however, was stiff and resisted deformation so that the minimum thickness obtained was 0.003" (in contrast to 0.002" for all other specimens). Whisker growth and adherence of this heat were acceptable, but wire life could not be The experimental heats shown in Table IV illustrate a marked decrease in the thermal cyclic oxidation resistance of the alloys when the chromium content is lowered to below 8%.

Figure 5:
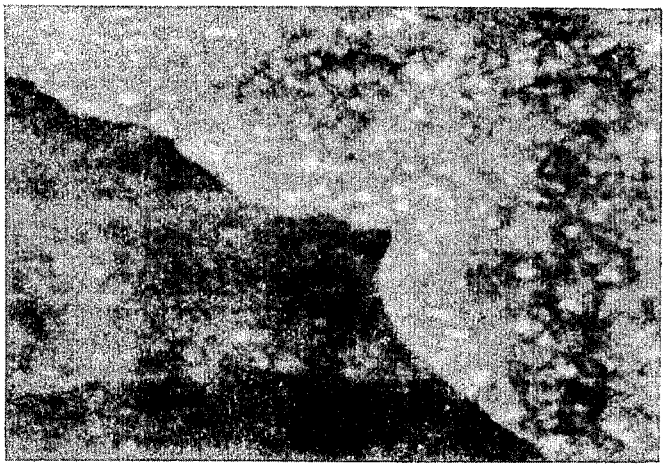
FIG. 5 is a photomicrograph of an alloy of a commercial electrical resistance heating element material.

FIG. 5 is a photomicrograph of a commercial electrical resistance heating element material identified as Kanthal A alloy. The material did not develop a whiskered surface oxide, as illustrated in the figure. Nominally, Kanthal A is an alloy having a composition of 0.06% carbon, 23.4% chromium, 6.2% aluminum, 1.9% cobalt and the balance iron.

The alloy of the present invention satisfies its objectives. A hot workable ferritic stainless steel alloy is provided, having good thermal cyclic oxidation resistance. The alloy retains an adherent aluminum oxide surface which is suitable to be texturized to increase the surface area for facilitating support of catalytic materials. Such an alloy is a good candidate for end uses which include electrical resisting heating elements and catalytic substrates, such as may be used in catalytic systems and converters for automobiles. The alloy is less expensive to produce than present alloys because of the lower cost of alloying elements and because it can be produced by lower cost melting processes.

While several embodiments of the present invention have been shown and described, it will be apparent to those skilled in the art that modifications may be made therein without departing from the scope of the invention.

What is claimed is:

1. A hot workable ferritic stainless steel alloy resistant to thermal cyclic oxidation and scaling at elevated temperatures and suitable for forming thereon an adherent textured aluminum oxide surface, the alloy consisting essentially of, by weight, 8.0–25.0% chromium, 3.0–8.0% aluminum, and an addition of at least 0.002% and up to 0.05% from the group consisting of cerium and lanthanum, neodymium and praseodymium, a total of all rare earths up to 0.060%, up to 4.0% silicon, 0.06% to 1.0% manganese and normal steelmaking impurities of less than 0.050% carbon, less than 0.050% nitrogen, less than 0.020% oxygen, less than 0.040% phosphorus, less than 0.030% sulfur, less than 0.50% copper, less than 1.0% nickel, and the sum of calcium and magnesium less than 0.005%, the remainder being iron.

2. The alloy as set forth in claim 1 stabilized with zirconium additions in amounts up to $$91\left[\left(\frac{\%\,C}{12}\right)+\left(\frac{\%\,N}{14}\right)+0.004\right]\%.$$

3. The alloy as set forth in claim 1 or 2 including niobium for stabilization and elevated temperature creep strength, in amounts up to $$93\left[\left(\frac{\%\,C}{12}\right)+\left(\frac{\%\,N}{14}\right)+0.013\right]\%.$$

4. The alloy as set forth in claim 1 wherein the rare earth addition is selected from the group consisting of cerium and lanthanum.

5. The alloy as set forth in claim 1 or 4 wherein minimum total amounts of the rare earth additions selected from the group consisting of cerium, lanthanum, or mixtures thereof are proportional to the chromium content as expressed by $$\frac{\%\,Cr}{2200}.$$

6. The alloy as set forth in claim 1 wherein minimum amounts of aluminum are based on the chromium content as expressed by $$\left[\frac{(40-\%\,Cr)}{6}\right]\%.$$

7. The alloy as set forth in claim 1 having up to 3% silicon.

8. The alloy as set forth in claim 1 having about 0.10 to 0.50% manganese.

9. A hot workable ferritic stainless steel alloy resistant to thermal cyclic oxidation and scaling at elevated temperatures and suitable for forming thereon an adherent textured aluminum oxide surface, the alloy consisting essentially of, by weight, 12.0–23.0% chromium, from $$\left[\frac{(40-\%\,Cr)}{6}\right]\%$$

up to 8.0% aluminum, and at least [%CR/2200]% of an addition from the group consisting of cerium and lanthanum, a total of all rare earths up to 0.050%, up to 3.0% silicon, 0.10 to 0.50% manganese, and normal steelmaking impurities of less than 0.030% carbon, less than 0.030% nitrogen, less than 0.010% oxygen, less than 0.030% phosphorus, less than 0.020% sulfur, less than 0.4% copper, less than 0.4% nickel, the sum of calcium and magnesium being less than 0.003%, the remainder being iron.

10. The alloy as set forth in claim 9 stabilized with zirconium additions in amounts up to $$91\left[\left(\frac{\%\,C}{12}\right)+\left(\frac{\%\,N}{14}\right)+0.003\right]\%.$$

11. The alloy as set forth in claim 9 or 10 including niobium for stabilization and elevated temperature creep strength, in amounts up to $$93\left[\left(\frac{\%\,C}{12}\right)+\left(\frac{\%\,N}{14}\right)+0.0075\right]\%.$$

12. An oxidation resistant catalytic substrate comprising a hot workable ferritic stainless steel alloy having an adherent textured aluminum oxide surface thereon, said alloy being resistant to thermal cyclic oxidation and scaling at elevated temperatures, said alloy consisting essentially of, by weight, 8.0–25.0% chromium, 3.0–8.0% aluminum, and an addition of at least 0.002% and up to 0.050% from the group consisting of cerium, lanthanum, neodymium and praseodymium, a total of all rare earths up to 0.060%, up to 4.0% silicon, 0.06 to 1.0% manganese and normal steelmaking impurities of less than 0.050% carbon, less than 0.050% nitrogen, less than 0.020% oxygen, less than 0.040% phosphorus, less than 0.030% sulfur, less than 0.50% copper, less than 1.0% nickel, and the sum of calcium and magnesium less than 0.005%, the remainder being iron.

13. The substrate as set forth in claim 12 wherein the steel is stabilized with zirconium additions up to $$91\left[\left(\frac{\%\,C}{12}\right)+\left(\frac{\%\,N}{14}\right)+0.004\right]\%.$$

14. The substrate as set forth in claim 12 or 13 wherein the steel includes niobium additions in the melt composition up to $$93\left[\left(\frac{\%\,C}{12}\right)+\left(\frac{\%\,N}{14}\right)+0.013\right]\%$$

for stabilization and elevated temperature creep strength.

15. The substrate as set forth in claim 12 wherein the rare earth addition is from the group consisting of cerium and lanthanum.

16. The substrate as set forth in claim 12 or 15 wherein minimum total amounts of the rare earth additions selected from the group consisting of cerium, lanthanum, or mixtures thereof are proportional to the chromium content as expressed by $$\frac{\%\,Cr}{2200}.$$

17. The substrate as set forth in claim 12 or 16 wherein minimum amounts of aluminum are based on the chromium content as expressed by $$\left[\frac{(40-\%\,Cr)}{6}\right]\%.$$

18. The substrate as set forth in claim 12 having up to 3% silicon.

19. The substrate as set forth in claim 12 having about 0.10 to 0.50% manganese.

20. An oxidation resistant catalytic substrate comprising a hot workable ferritic stainless steel alloy having an adherent textured aluminum oxide surface thereon, said alloy being resistant to thermal cyclic oxidation and scaling at elevated temperatures, said alloy consisting essentially of, by weight, 12.0–23.0% chromium, $$\left[\frac{(40 - \%\ Cr)}{6}\right]\%$$

up to 8% aluminum, and at least [%CR/2200]% of an addition from the group consisting of cerium and lanthanum, a total of all rare earths up to 0.050%, up to 3.0% silicon, 0.10 to 0.50% manganese and normal steelmaking impurities of less than 0.030% carbon, less than 0.030% nitrogen, less than 0.010% oxygen, less than 0.030% phosphorus, less than 0.020% sulfur, less than 0.40% copper, less than 0.40% nickel, and the sum of calcium and magnesium less than 0.003%, the remainder being iron.

21. The substrate as set forth in claim 20 stabilized with zirconium additions in amounts up to $$91\left[\left(\frac{\%\ C}{12}\right) + \left(\frac{\%\ N}{14}\right) + 0.003\right]\%.$$

22. The substrate as set forth in claim 20 or 21 including niobium for stabilization and elevated temperature creep strength in amounts up to $$93\left[\left(\frac{\%\ C}{12}\right) + \left(\frac{\%\ N}{14}\right) + 0.0075\right]\%.$$

23. A catalyst system comprising an oxidation resistant catalytic substrate of claims 12 or 20.

* * * * *